US007010134B2

(12) United States Patent
Jensen

(10) Patent No.: US 7,010,134 B2
(45) Date of Patent: Mar. 7, 2006

(54) HEARING AID, A METHOD OF CONTROLLING A HEARING AID, AND A NOISE REDUCTION SYSTEM FOR A HEARING AID

(75) Inventor: Lars Baekgard Jensen, Varlose (DK)

(73) Assignee: Widex A/S, Varlose (DK)

( * ) Notice: Subject to any disclaimer, the term of this patent is extended or adjusted under 35 U.S.C. 154(b) by 41 days.

(21) Appl. No.: 10/685,541

(22) Filed: Oct. 16, 2003

(65) Prior Publication Data

US 2004/0081327 A1 Apr. 29, 2004

Related U.S. Application Data

(63) Continuation-in-part of application No. PCT/DK02/00248, filed on Apr. 12, 2002.

(30) Foreign Application Priority Data

Apr. 18, 2001 (DK) ..... 2001 00621

(51) Int. Cl.
*H04R 25/00* (2006.01)

(52) U.S. Cl. ..... 381/313; 381/92; 381/356

(58) Field of Classification Search ..... 381/23.1, 381/91, 92, 122, 312, 313, 320, 321, 356–358, 381/328, 355, FOR 128, FOR 142, FOR 147
See application file for complete search history.

(56) References Cited

U.S. PATENT DOCUMENTS

| | | | |
|---|---|---|---|
| 5,402,496 | A | 3/1995 | Soli et al. |
| 5,473,701 | A | 12/1995 | Cezanne et al. |
| 5,524,056 | A | 6/1996 | Killion et al. |
| 5,757,933 | A | 5/1998 | Preves et al. |
| 5,761,442 | A | 6/1998 | Barr et al. |
| 5,930,762 | A | 7/1999 | Masch |
| 6,021,397 | A | 2/2000 | Jones et al. |
| 6,078,904 | A | 6/2000 | Rebane |
| 6,175,824 | B1 | 1/2001 | Breitzman et al. |
| 6,249,775 | B1 | 6/2001 | Freeman et al. |
| 2001/0008559 | A1 | 7/2001 | Roo |

FOREIGN PATENT DOCUMENTS

| | | | |
|---|---|---|---|
| DE | 198 22 021 | A | 12/1999 |
| DE | 198 49 739 | A | 5/2000 |
| DE | 199 27 278 | C | 12/2000 |
| WO | WO 01/01731 | A1 | 1/2001 |
| WO | WO 01/01732 | A1 | 1/2001 |
| WO | WO 01/10169 | A | 2/2001 |
| WO | WO 01/26415 | A1 | 4/2001 |
| WO | WO 02 03750 | A | 1/2002 |

*Primary Examiner*—Huyen Le
(74) *Attorney, Agent, or Firm*—Sughrue Mion, PLLC

(57) ABSTRACT

A directional hearing aid comprises a front microphone (11) and a back microphone (12), a delay processor (13, 14) for processing, according to a control parameter, the respective microphone signals, and means (8*a*) for adjusting the control parameter in order to minimize the output signal from the delay processor. The control parameter may be adjusted to change smoothly the function mode of a hearing aid between omnidirectional mode, a directional mode and a directional mode with a pair of null directions, symmetrical about the 180° direction. The directional controller may be implemented in a multichannel version. The invention provides a hearing aid, a method of controlling a hearing aid, a noise reduction system and a method of reducing noise in a hearing aid.

13 Claims, 6 Drawing Sheets

HEARING AID, A METHOD OF CONTROLLING A HEARING AID, AND A NOISE REDUCTION SYSTEM FOR A HEARING AID

RELATED APPLICATIONS

The present application is a continuation-in-part of application No. PCT/DK02/00248, filed on Apr. 12, 2002, in Denmark. The present application is further based on PA 2001 00621, filed on Apr. 18, 2001 in Denmark, the contents of which are incorporated hereinto by reference.

BACKGROUND OF THE INVENTION

1. Field of the Invention

The present invention generally relates to hearing aids and to methods of controlling hearing aids. More specifically, the invention relates to hearing aids with a directional capability, based on reception of sound in at least two microphones. Still more specifically, the invention relates to noise reduction, and, particularly, to the reduction of the noise received by a hearing aid user, through a hearing aid being of the type with multiple microphones. The invention still more particularly relates to a system for controlling the directional characteristic of sound input systems.

2. The Prior Art

Hearing aids having a directional sound receiving characteristic are useful to improve speech perception in noisy environments, where sound signals may be received simultaneously from different directions, as is the case e.g. in the noise environment frequently referred to as cocktail party noise. With a directional sound receiving characteristic, e.g. in the shape of a cardioid or super cardioid characteristic, the perception ot speech received in a hearing aid from directions in front of the user may be improved by reducing the reception of sound coming from the back of the user, while maintaining the level of sound coming from the area in front of the user. On the other hand, in environments with only a low noise level or no significant speech signals the hearing aid user will normally prefer an omnidirectional or spherical sound receiving characteristic, offering the same perception of sound irrespective of the direction, from which it arrives.

U.S. Pat. No. 5,757,933 shows a directional controller employing two microphones and a switch. The switch allows the user to switch between a directional mode and a omnidirectional mode. The function of the directional controller is to provide the user with a possibility of reducing the sound receiving characteristic of the microphone system for undesired signals that are spatially separated from a desired signal.

U.S. Pat. No. 5,259,033 shows a parameter controller with an LMS-algorithm.

U.S. Pat. No. 5,757,933 shows a directional controller employing two microphones and a switch. The switch allows the user to switch between a directional mode and a omnidirectional mode. The function of the directional controller is to provide the user with a possibility of reducing the sound receiving characteristic of the microphone system for undesired signals that are spatially separated from a desired signal.

U.S. Pat. No. 5,259,033 shows a parameter controller with an LMS-algorithm.

U.S. application Ser. No. 09/445,485, filed Dec. 7, 2000, now abandoned, provides a hearing aid with a controllable directional characteristic, which may change from an omnidirectional to a directional characteristic and vice versa. The hearing aid has two spaced apart microphones and a directional controller including a delay device for delaying the signal from one of the microphones. The hearing aid may be changed between a directional mode and an omnidirectional mode. The delay may be adjusted in order that the direction of the canceling effect is controlled.

U.S. application Ser. No. 09/696,264, filed Oct. 26, 2000, as a c-i-p of U.S. application Ser. No. 09/445,485 mentioned above, provides a method for controlling the directionality of the sound receiving characteristic of a hearing aid comprising spaced apart microphones, wherein the sound receiving characteristic may change between an omnidirectional characteristic and a directional characteristic. In this hearing aid, an adjustable time or phase delay may be imposed. The directional characteristic may be created by adjusting the delay of the delay device to be the same as the acoustical delay between the back microphone and the front microphone. With this delay, the signals, that are first received at the back microphone and are later received at the front microphone, are suppressed in the adding circuit, where the delayed signal of the back microphone is subtracted from the output signal of the front microphone. The hearing aid may exercise a smooth change-over between an omnidirectional characteristic and a directional characteristic, substantially without changing the phase relationship or time delay and the amplitude characteristic of the signals.

Such a directional control provides the user with the possibility of altering the sound receptive property of the hearing aid, whereby it is possible to reduce the influence of a noise source on the users perception of a desired sound source. However, it would be an advantage if the hearing aid it-self would be able to control the directional characteristic.

SUMMARY OF THE INVENTION

Accordingly, it is an objective of the present invention to provide a hearing aid with an automatic control of the directional characteristic.

The invention, in a first aspect, provides a hearing aid comprising a front microphone for outputting a front signal $X_{front}$; a back microphone for outputting a back signal $X_{back}$; a delay processor adapted for processing said front signal and said back signal according to a parametric input and for outputting a directionally processed signal according to the formula:

$$Y=X_{front}*(1-omni*e^{-j\omega T})+X_{back}*(omni-e^{-j\omega T})$$

where T is a predetermined acoustic delay; a signal processor for processing said directionally processed signal; and a parameter control means for estimating said directionally processed signal and for setting a value of the parameter omni suitable for minimizing said directionally processed signal.

The invention, in a second aspect, provides a hearing aid comprising a front microphone for outputting a front signal $X_{front}$; a back microphone for outputting a back signal $X_{back}$; a set of frequency band filters for splitting said front signal and said back signal into a set of front input channel signals and a set back channel signals; a set of channel delay processors for separately processing said front input channel signals and said back input channel signals according to respective parametric inputs and for outputting a set of directionally processed channel signals, each according to the formula:

$$Y=X_{front}*(1-omni*e^{-j\omega T})+X_{back}*(omni-e^{-j\omega T})$$

where omni is a parameter of a respective channel and T is a predetermined acoustic delay; a set of parameter controllers for separately processing respective directionally processed channel signals and ouputting respective channel parameters; and a combining unit for combining said directionally processed channel signals to provide a combined directionally processed signal.

The invention, in a third aspect, provides a method of controlling a hearing aid, comprising processing in a delay processor signals from at least a front microphone and a back microphone according to a parametric input omni for outputting a directionally processed signal according to the formula:

$$Y=X_{front}*(1-omni*e^{-j\omega T})+X_{back}*(omni-e^{-j\omega T})$$

where T is a predetermined acoustic delay; estimating said directionally processed signal; and setting a value of the parameter omni suitable for minimizing said directionally processed signal.

The invention, in a fourth aspect, provides a noise reduction system for a hearing aid, comprising a directional controller capable of adjusting the sound receptive property of the microphone system to change, according to a control parameter, between an omnidirectional characteristic, a directional characteristic and a directional characteristic with moving null-directions; and an adaptive controller adapted for automatically adjusting the control parameter so as to move a null-direction to reduce the noise signal.

The invention, in a fifth aspect, provides a method for reducing noise in a hearing aid, comprising receiving an acoustical signal in a microphone system, processing outputs of the microphone system in a parameter controlled delay processor adapted for changing, according to a control parameter, between an omnidirectional characteristic, a directional characteristic and a directional characteristic with moving null-directions, and adjusting the parameters that control the delay processor with an adaptive controller so as to minimize the output signal from the delay processor.

Further embodiments of the invention, whereby further advantages in the reduction of the influence of noise sources may be obtained, will appear from the dependent claims.

Even though it is particularly advantageous to utilize this multichannel directional controller in a hearing aid with adaptive control of the directional controller, this multichannel controller may also be utilized in other types of hearing aids, e.g. hearing aids with user control of the directional characteristic. This is due to the fact that noise sources often have a limited frequency spectrum, such that one noise source may be disturbing in the low frequency channels and in one particular direction, while another noise source may be disturbing in the high frequency channels and in another direction. Thus, this novel multichannel directional controller will provide the user with the possibility of minimizing the influence of multiple noise sources in a multitude of directions, given that the noise sources are, at least partially, separated in the frequency spectrum.

BRIEF DESCRIPTION OF THE DRAWINGS

The invention will now be described in more detail in conjunction with several embodiments and the accompanying drawings, in which.

DETAILED DESCRIPTION OF THE INVENTION

Figure 1:
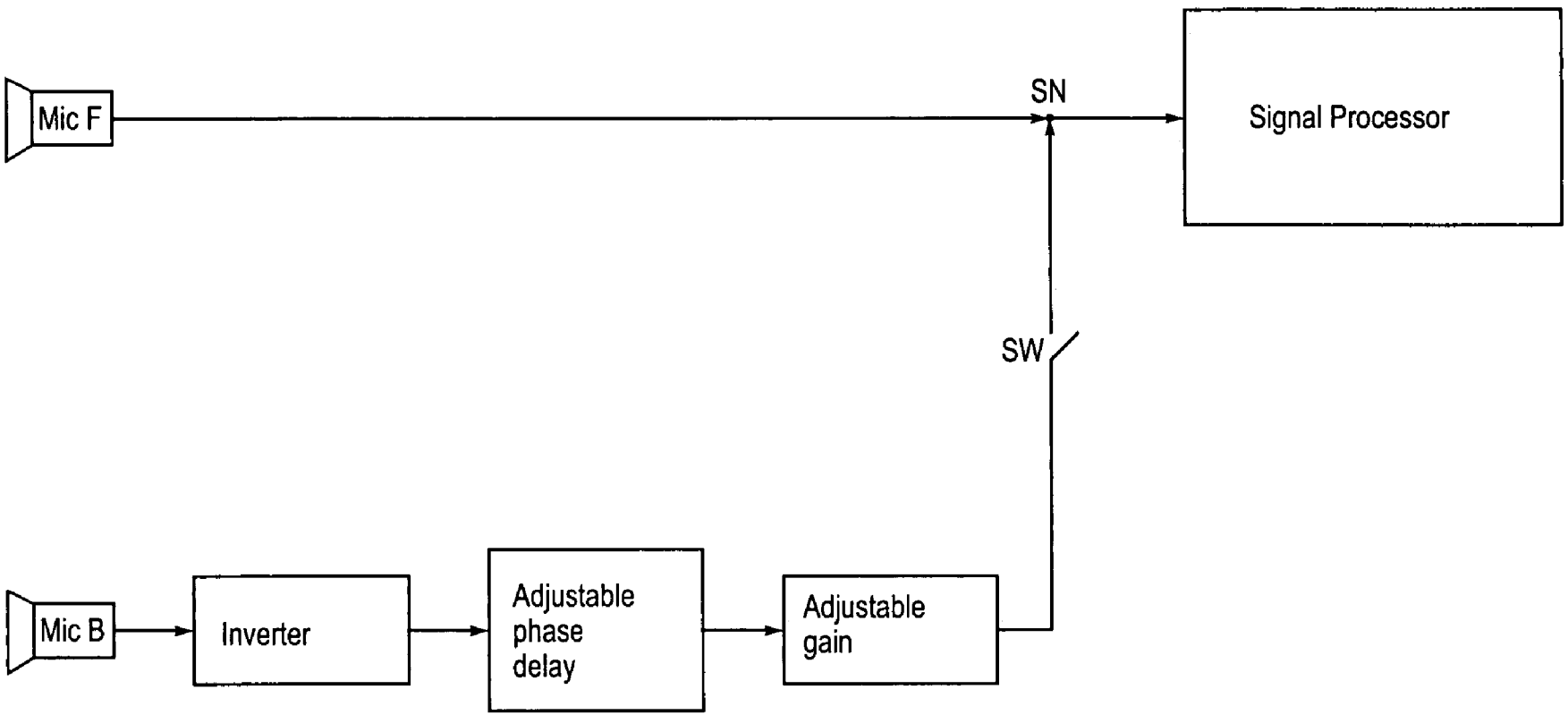
PRIOR ART Fig. 1
FIG. 1 shows a directional controller for a hearing aid, according to U.S. Pat. No. 5,757,933.

FIG. 1 shows a directional controller, according to U.S. Pat. No. 5,757,933. This system comprises two microphones mic F and mic B, an inverter, a switch SW, a summing node SN, an adjustable phase delay device and an adjustable gain device. The switch SW is provided in order to enable the user to switch between a directional mode and an omnidirectional mode.

Whereas the output signal from the front microphone is supplied directly to the hearing aid signal processor via a summing node SN, the signal from the back microphone is supplied to the summing node SN via the inverter, the adjustable phase delay circuit and the attenuator with adjustable gain. Switching the switch into conductive state places the directional controller in directional mode. In this mode, the directional controller effectively applies a phase delay to one of the microphone signals and subtracts the delayed signal from the other one of the microphone signals, whereby acoustic signals from some directions are enhanced compared to signals from other directions. The direction where the sound receptive property will be enhanced is determined by the value of the phase delay relative to the acoustic delay between the back microphone and the front microphone, as further described in U.S. Pat. No. 5,757,933. Thus, the function of the directional controller is to provide the user with a possibility of reducing the sound receiving characteristic of the microphone system for undesired signals that are spatially separated from a desired signal.

Figure 2:
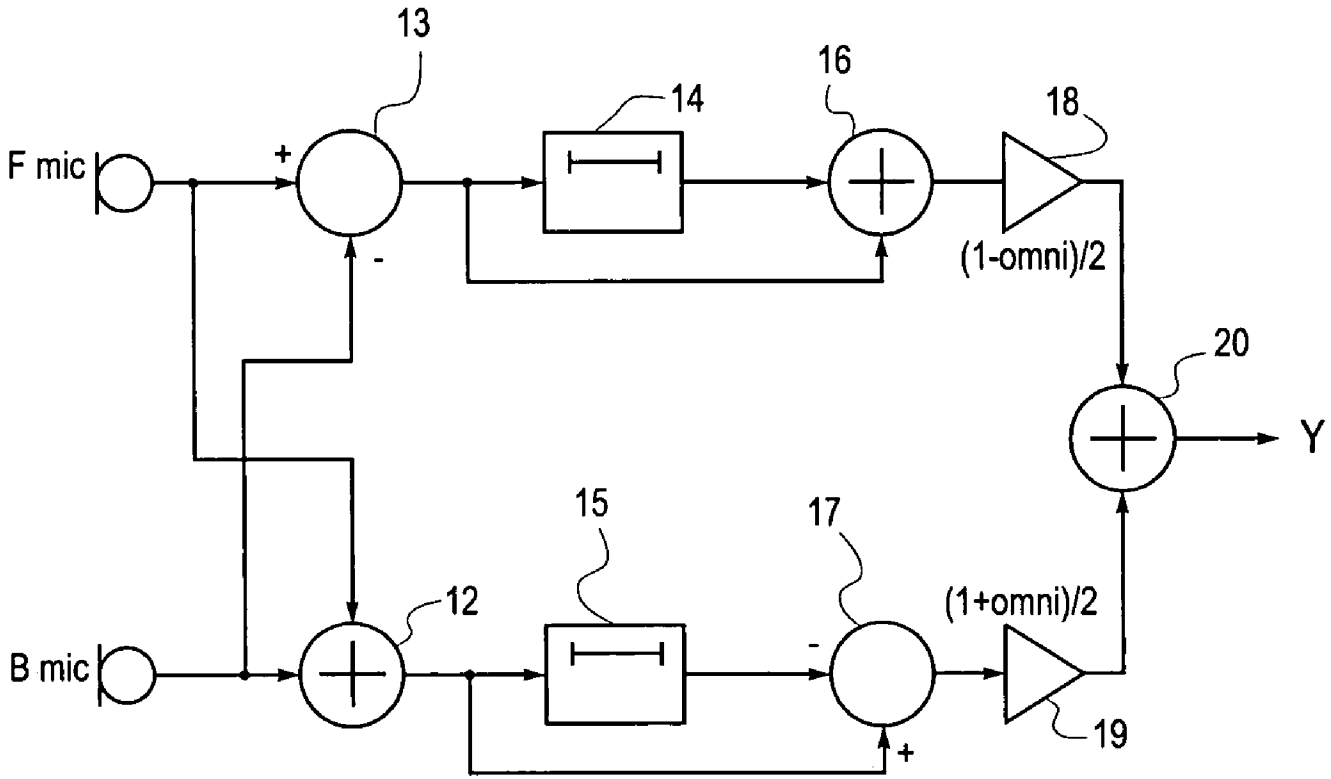
PRIOR ART Fig. 2
FIG. 2 shows a directional controller for a hearing aid, according to U.S. application Ser. No. 09/696,264.

U.S. application Ser. No. 09/696,264, the contents of which are incorporated hereinto by reference, shows a directional controller as depicted in FIG. 2. In this controller, controllable attenuation and phase delay operations are applied to the signals from the front and back microphones Fmic and Bmic, and the resulting signals are then combined. The circuit structure, in the following generally referred to as the delay processor, comprises a first adding circuit 12 connected with the front and back microphones Fmic and Bmic and a first subtraction circuit 13 having a positive input connected with the front microphone Fmic and a negative input connected with the back microphone Bmic. First and second phase delay devices 14 and 15 are connected with the first subtraction and adding circuits 13 and 12, respectively. A second adding circuit 16 is connected with the first subtraction circuit 13 and the first phase delay device 14, and a second subtracting circuit 17 has its positive input connected with the first adding circuit 12 and its negative input connected with second phase delay device 15.

A first controllable attenuator 18 acts on the signal from the second adding circuit 16 for attenuation of this signal by a factor (1−omni)/2, where omni represents a parametric control signal. A second controllable attenuator 19 acts on the signal from the second subtraction circuit 17 for attenuation of this signal by a factor (1+omni)/2. A third adding circuit 20 is connected with the first and second attenuators 18 and 19 for summing of the signals therefrom to provide the overall combined signal to be supplied to the signal processor. The microphones used are preferably omnidirectional microphones.

This controller, which will be described in the following text, may advantageously be utilized in connection with the present invention. The combined signal Y from adding circuit 20 is $$Y=X_{froni}*(1-omni*e^{-j\omega T})+X_{back}*(omni-e^{-j\omega T})$$

where omni is an adjustable parameter, controlling attenuators 18 and 19 and having preferably a value in the range from 0 to 1. If a mode of operation is chosen with omni=0, the combined signal Y becomes $$Y=X_{froni}*(1-e^{-j\omega(A+T)})$$

If the delay T is selected equal to the delay A directly from the back microphone to the front microphone in the directional mode of operation, then the part of the sound signal X coming directly from the back of the user is suppressed to the maximum extent and a directional characteristic known as a cardioid characteristic is achieved.

Figure 3:
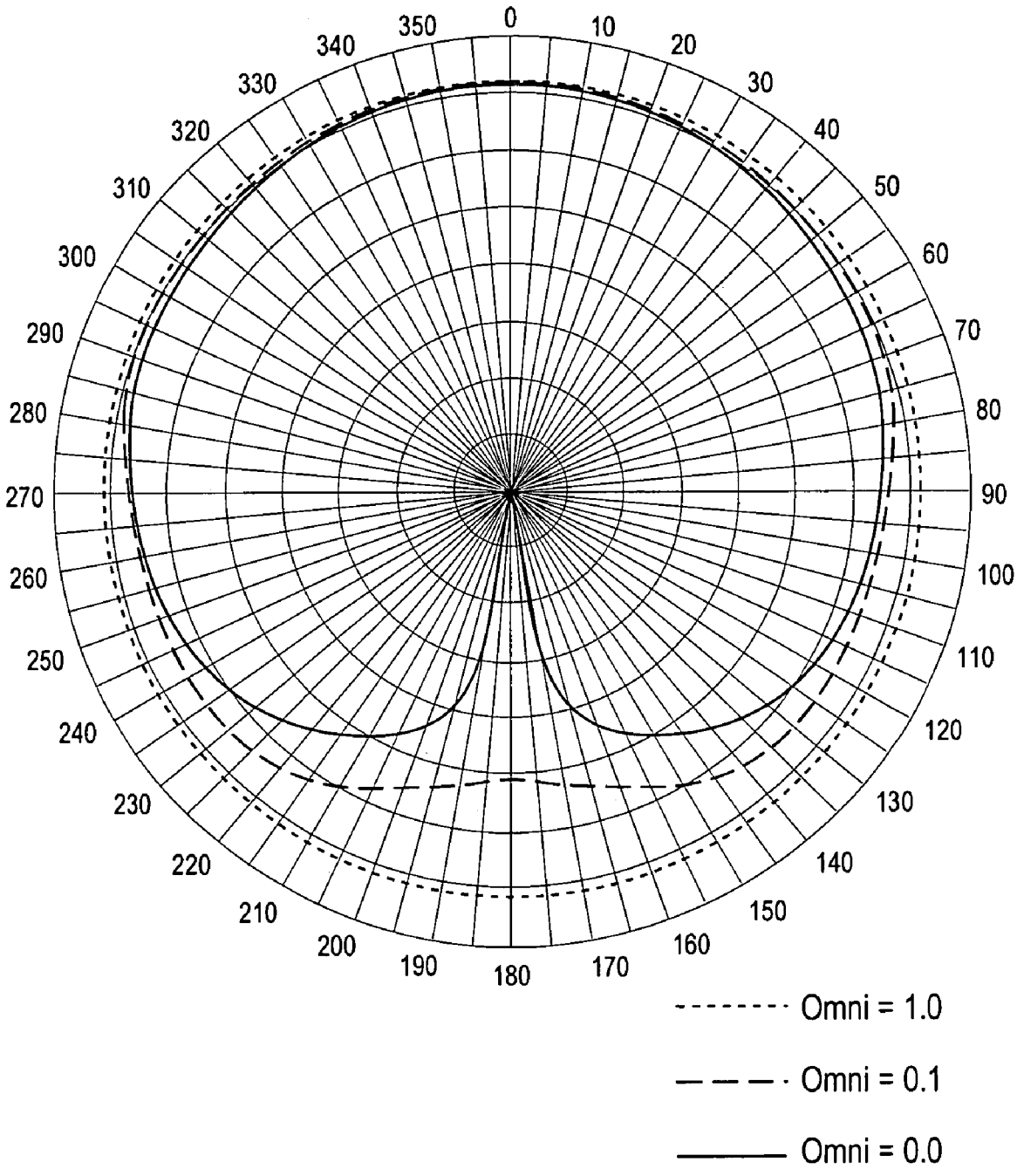
FIG. 3 shows an example of a directional characteristic.

In FIG. 3 the directional characteristics of the controller of FIG. 2 is shown, for some different values of the parameter omni, ranging from omni=1 to 0. From this Fig. it can be seen that for omni=1.0 the characteristic is omni-directional. For omni=0.1, there is some attenuation of signals close to 180° direction (the direction opposite the users face). For omni=0.0 the directional characteristic shows very high attenuation (a so-called null-direction) in the 180° direction. Thus, decreasing values of omni provide gradually increased directionality.

Figure 4:
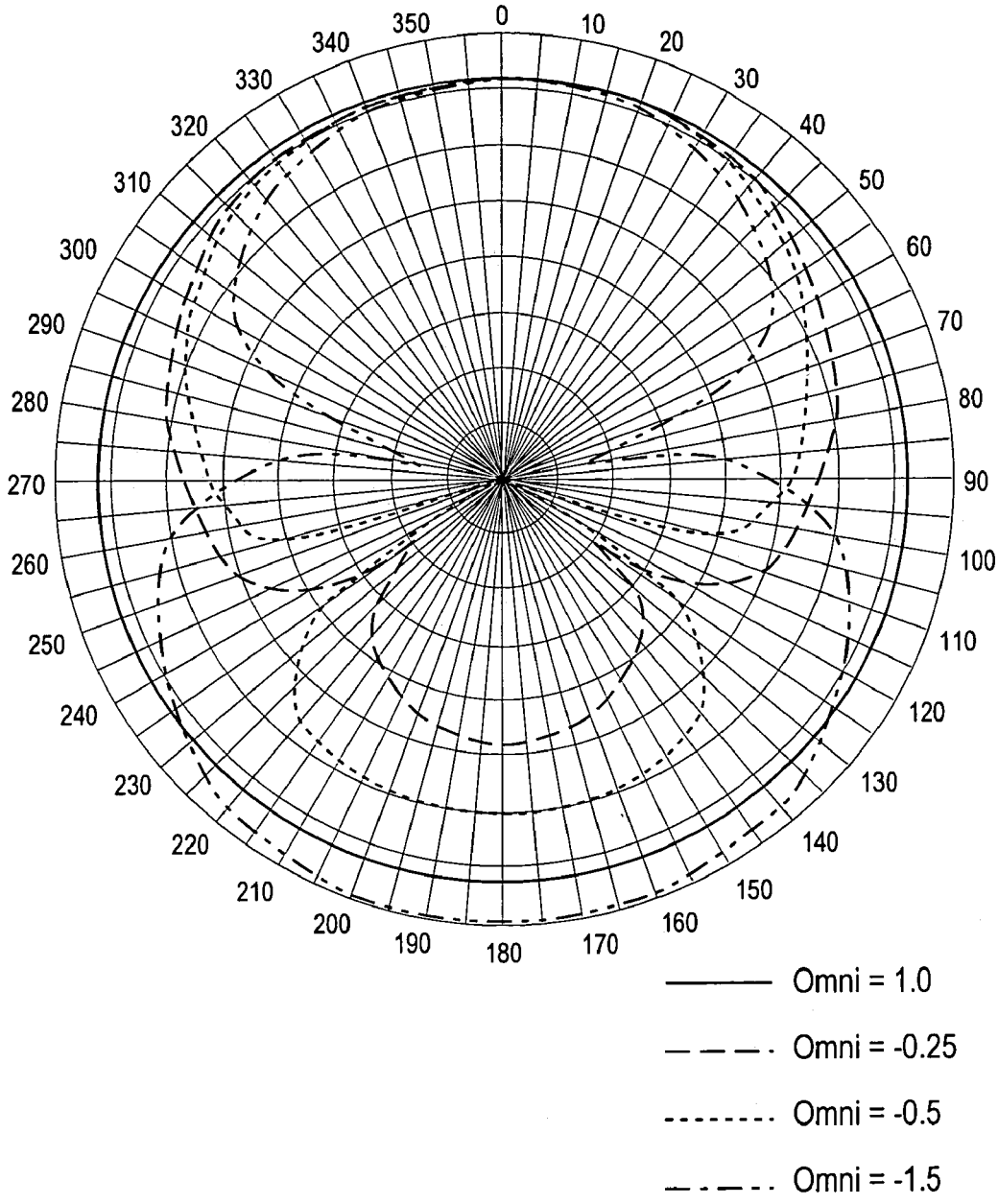
FIG. 4 shows another example of a directional characteristic.

However, according to the invention, the parameter omni may assume values outside the range 0 to 1. Thus, FIG. 4 shows other characteristics of the controller of FIG. 2, for some other omni values. From this Fig. it can be seen that when omni is reduced below zero, there will appear two null-directions, symmetrical about the 180° direction. Increasingly negative values of omni will move the null directions further away from the 180° direction. E.g., at omni=−1.5 the null-directions will be at 80 and 280 degrees.

Conclusively, by adjusting the parameter omni it will be possible to move the null-directions of the directional controller. This can, according to the invention, advantageously be exploited in an adaptive control of the directional controller as shown in FIG. 5.

Figure 5:
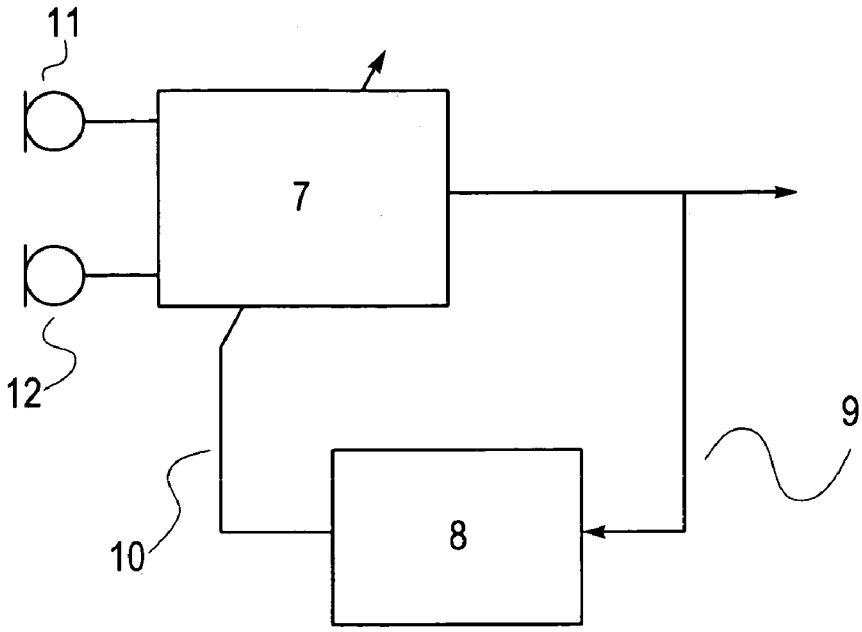
FIG. 5 shows a parameter controller of a directional controller.

In FIG. 5 a delay processor 7 is controlled by a parameter controller 8. The parameter controller 8 adjusts the parameter omni—illustrated with the control line 10—in order to minimize the output signal 9 from the delay processor 7. It is well-known to a skilled person how to provide such an adaptive control, e.g. by applying a LMS-algorithm in the parameter controller. Examples on a parameter controller with an LMS-algorithm can be found in e.g. U.S. Pat. No. 5,259,033 or U.S. Pat. No. 5,402,496, however, these adaptive control systems do not control a delay processor.

It is noted, that even though the system of FIG. 5 uses two microphones 11 and 12 and a delay processor of the type shown on FIG. 2, the invention is not limited in scope to delay processors with two microphones. Contrary, it will be obvious to a skilled person, how other microphone systems (with more than two microphones) and other types of delay processors may be combined with an adaptive control according to the invention. Thus, such modifications should not be considered outside the scope of the invention.

According to a preferred embodiment of the invention, the adaptive control may advantageously be combined with band-limited delay processors. In order to explain the basic principle, reference is first made to FIG. 6, wherein a system, according to an embodiment of the invention, with band-limited delay processors is shown.

Figure 6:
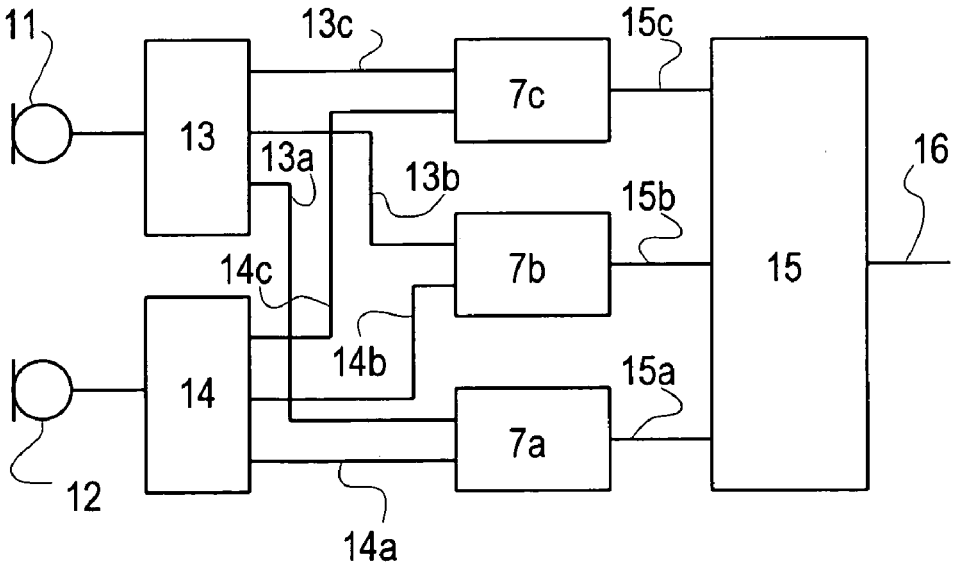
FIG. 6 shows a multichannel delay processor.

In FIG. 6 the two microphones 11 and 12 (which may include A/D-converters and microphone matching circuits) are connected to band-split filters, 13 and 14 respectively. These filters divide the frequency spectrum of the microphone signals into a number, e.g. three, of channels (on the output-lines 13*a*–13*c*, respectively 14*a*–14*c*) with respective limited frequency ranges. Each of the band-limited channels is handled by a corresponding delay processor (7*a*–7*c*), whereby each delay processor operates in a band-limited channel. This system allows the directional characteristics to be different among these channels, such that noise sources that are separated both spatially and in frequency may be attenuated by controlling each delay processor independently.

The outputs 15*a*–15*c* of the delay processors may be combined to a single output signal in a combining unit 15, which may comprise means such as a hearing aid processor for processing signals for compensation of the hearing impairment. According to an embodiment of the invention, the number of channels in the adaptive directional system is equivalent to the number of channels in a multichannel hearing aid, whereby each output 15*a*–15*c* may be processed separately in a corresponding channel in the hearing aid processor for subsequently being combined with other processed channel signals.

Figure 7:
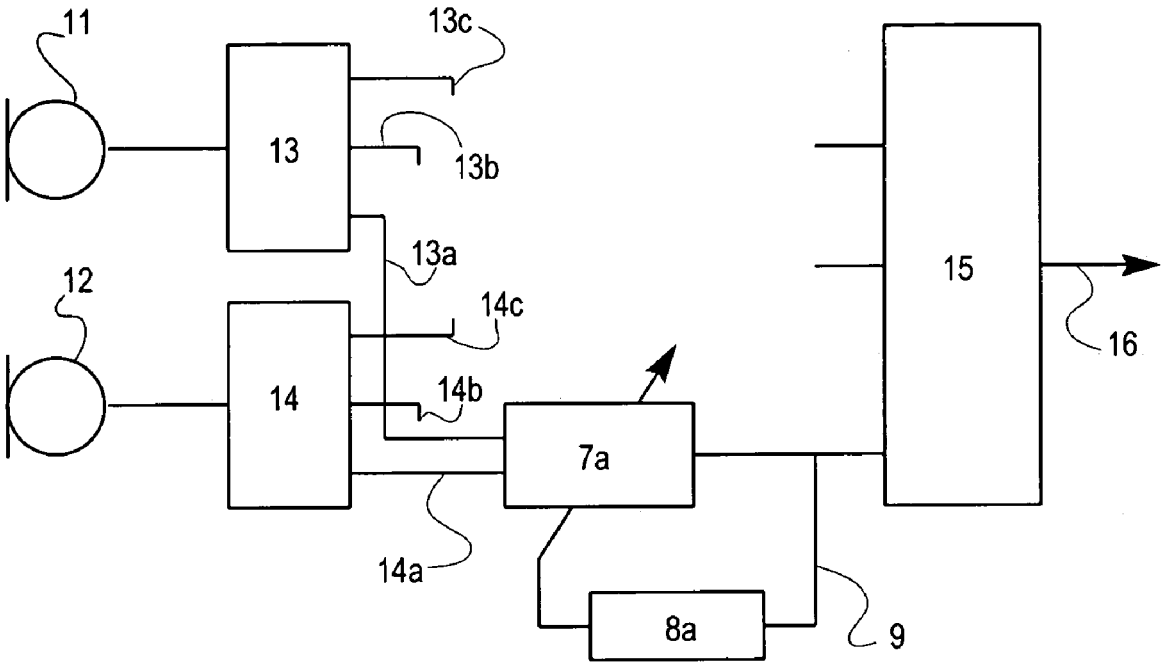
FIG. 7 shows an adaptive control of a multichannel directional controller.

Since such a system requires adjustment of multiple delay processors, an adaptive control, according to an embodiment of the invention, may advantageously be exploited. This is shown in FIG. 7. In this system, each of the channels is provided with a respective delay processor 7*a*–7*c* and a respective parameter controller 8*a*–8*c* (FIG. 7 shows a delay processor 7*a* and a parameter controller 8*a* in respect of just one of the channels). Each of the controllers 7*a*–7*c* is controlled by a respective parameter controller 8*a*–8*c*, whereby noise sources are automatically attenuated in each channel. As described above, the block 15 may be either a combining node or a hearing aid processor.

It is noted, that even though the invention has been described in connection with delay processors where it is inherent that the main-direction (the direction of intended maximum gain) is fixed, the scope of the invention should not be limited to such a system. A skilled person will be able to suggest systems wherein the main-direction is adjustable, e.g. by providing an additional microphone whose output signal is combined with the output of the directional system in yet another delay processor. Furthermore, a skilled person will be able to suggest means whereby the main-direction may be controlled by a parameter controller, in such a way that the combined adaptive control of both main-direction and directional characteristic is exploited to minimize the influence of noise sources without an unacceptable reduction in the receptive property for the desired signal.

I claim:

1. A hearing aid comprising a front microphone for outputting a front signal $X_{front}$;

a back microphone for outputting a back signal $X_{back}$;

a delay processor adapted for processing said front signal and said back signal according to a parametric input and for outputting a directionally processed signal according to the formula:

$$Y=X_{front}*(1-omni*e^{-j\omega T})+X_{back}*(omni-e^{-j\omega T})$$

where omni is a parametric control signal and T is a predetermined acoustic delay;

a signal processor for processing said directionally processed signal; and a parameter control means for estimating said directionally processed signal and for setting a value of the parametric input omni suitable for minimizing said directionally processed signal.

2. The hearing aid according to claim 1, wherein said parameter control means is adapted for controlling the parameter omni within the range from minus 1.5 to plus 1.0.

3. The hearing aid according to claim 1, wherein said parameter control means is adapted for controlling the parameter omni to achieve a pair of null directions, symmetrical about the 180° direction.

4. The hearing aid according to claim 1, wherein said parameter control means is adapted for minimizing said directionally processed signal by applying an LMS algorithm.

5. The hearing aid according to claim 1, wherein said signal processor is adapted for processing said directionally processed signal for compensation of a hearing impairment.

6. A hearing aid comprising a front microphone for outputting a front signal $X_{front}$;

a back microphone for outputting a back signal $X_{back}$;

a set of frequency band filters for splitting said front signal $X_{front}$ and said back signal $X_{back}$ into respective input channel signals;

a set of channel delay processors for separately processing respective input channel signals according to respective channel parametric inputs and for outputting respective directionally processed channel signals according to the formula;

$$Y=X_{front}*(1-omni*e^{-j\omega T})+X_{back}*(omni-e^{-j\omega T})$$

where omni is a parametric input and T is a predetermined acoustic delay;

a combining unit for combining said directionally processed channel signals to provide a combined, processed, signal; and a set of parameter controllers for separately processing respective directionally processed channel signals and for setting respective channel values of the parametric input omni suitable for minimizing said directionally processed signal.

7. A hearing aid comprising a front microphone for outputting a front signal $X_{front}$;

a back microphone for outputting a back signal $X_{back}$;

a set of frequency band filters for splitting said front signal and said back signal into a set of front input channel signals and a set back channel signals;

a set of channel delay processors for separately processing said front input channel signals and said back input channel signals according to respective parametric inputs and for outputting a set of directionally processed channel signals, each according to the formula:

$$Y=X_{front}*(1-omni*e^{-j\omega T})+X_{back}*(omni-e^{-j\omega T})$$

where omni is a parameter of a respective channel and T is a predetermined acoustic delay;

a set of parameter controllers for separately processing respective directionally processed channel signals and outputting respective channel parameters; and a combining unit for combining said directionally processed channel signals to provide a combined directionally processed signal.

8. A method of controlling a hearing aid, comprising providing from a front microphone a front signal $X_{front}$;

providing from a rear microphone a back signal $X_{back}$;

processing in a delay processor the front signal $X_{front}$ and the back signal $X_{back}$ according to a parametric input omni for outputting a directionally processed signal according to the formula:

$$Y=X_{front}*(1-omni*e^{-j\omega T})+X_{back}*(omni-e^{-j\omega T})$$

where omni is a parametric input and T is a predetermined acoustic delay;

estimating said directionally processed signal; and setting a value of the parametric input omni suitable for minimizing said directionally processed signal.

9. The method according to claim 8, comprising controlling the parameter omni within the range from 1.0 to −1.5.

10. The method according to claim 8, comprising controlling the parameter omni to achieve a pair of null directions, symmetrical about the 180° direction.

11. The method according to claim 8, comprising minimizing the output signal from the delay processor by applying an LMS algorithm.

12. A method of controlling a hearing aid, comprising providing from a front microphone a front signal $X_{front}$;

providing from a rear microphone a back signal $X_{back}$;

splitting the front signal $X_{front}$ and the back signal $X_{back}$ according to frequency into respective band-limited signals, processing in a delay processor the band-limited signals with respective channel delay processors to produce output signals in respective frequency bands according to respective channel values of a parametric input omni for outputting directionally processed signals in respective bands according to the formula:

$$Y=X_{front}*(1-omni*\ e^{-j\omega T})+X_{back}*(omni-e^{-j\omega T})$$

where omni is a parameter of a respective channel and T is a predetermined acoustic delay;

estimating said directionally processed signal; and setting respective channel values of the parametric input omni suitable for minimizing said directionally processed signal.

13. The method according to claim 12, comprising combining the signals from the respective channel delay processors; and processing said directionally processed signal for compensation of a hearing impairment.

* * * * *